US005496191A

United States Patent [19]

Johnston

[11] Patent Number: 5,496,191

[45] Date of Patent: Mar. 5, 1996

[54] CORD ASSEMBLY AND METHOD FOR MAKING

[75] Inventor: James J. Johnston, Newington, Conn.

[73] Assignee: The Wiremold Company, West Hartford, Conn.

[21] Appl. No.: 228,104

[22] Filed: Apr. 15, 1994

[51] Int. Cl.[6] ..... H01R 4/24

[52] U.S. Cl. ..... 439/404; 29/858

[58] Field of Search ..... 439/404, 496, 439/894.1; 29/858, 857

[56] References Cited

U.S. PATENT DOCUMENTS

| | | | |
|---|---|---|---|
| 3,761,842 | 9/1973 | Gandrud | 439/894.1 X |
| 4,671,596 | 6/1987 | Soma | 439/404 |
| 5,312,270 | 5/1994 | Siemon et al. | 439/404 X |

OTHER PUBLICATIONS

Components Report XIII, Siemens AG, pp. 190–193 Nov. 1978.

*Primary Examiner*—Larry I. Schwartz
*Assistant Examiner*—Daniel Wittels
*Attorney, Agent, or Firm*—McCormick, Paulding & Huber

[57] ABSTRACT

A cord assembly including an insulated electric cord containing a plurality of twisted pairs of insulated solid wire conductors and terminated by a plug having an inner part and an outer part. Terminal end portions of the conductors wrapped about an inner part and trapped between the inner and outer parts extend across an opening in the plug for direct releasable plugging connection with an inline array of insulation displacement contacts (IDCs) carried by a mating connector block mounted on a cross-connect panel. An assembly jig is used to position the conductor terminal end portions and supports the inner part while the terminal end portions are wrapped about the inner part.

19 Claims, 5 Drawing Sheets

CORD ASSEMBLY AND METHOD FOR MAKING

BACKGROUND OF THE INVENTION

This invention relates in general to electrical cord assemblies and deals more particularly with an improved modular plug and cord assembly for telephonic and/or data signal transmission and a method for making such an assembly.

The cord assembly of the present invention is particularly adapted for use as a patch cord on a cross-connect panel, such as an AT&T 110 type panel. Such a cross-connect panel meets EIA/TIA Commercial Building Standards —"Category 5" requirements-and provides a convenient centralized location for networking the communications and data processing systems within a building and for interconnecting the systems with an outside telecommunication network. When problems of signal coupling (crosstalk) or intermittent contact (clicking) occur in such a cross-connect panel system these problems can usually be attributed to the patch cords used with the system.

A typical patch cord for a modern cross-connect panel system of the aforedescribed general type includes a flexible stranded wire cord with a patch plug attached to each end. The patch plug generally has a housing containing an inline array of flat contact blades adapted to be simultaneously pressed or plugged into and extracted from an equal number of mating insulation displacement contacts (IDCs) mounted on and projecting from the cross-connect panel. Typically the contact blades within the plug housing are connected to individual stranded wire conductors in the patch cord by IDC terminations.

While stranded wire patch cords afford the advantages of flexibility, for ease of cable buildup during panel board installation, and enhance high frequency transmission performance, due to increased pair twisting capability, these advantages do not adequately compensate for the basic incompatibility of IDC technology and stranded wire. Further, the initial concept of mass termination to enhance efficiency by cross-connecting an entire network (four pair), as opposed to terminating individual conductors, is seriously flawed by insertion of eight relatively large flat formed blade contacts at each end of the patch cord into associated IDC slots on a cross-connect panel.

U.S. Pat. No. 5,226,835 to Baker III, et al entitled Patch Plug For Cross-Connect Equipment, issued Jul. 13, 1993 and assigned to AT&T Bell Laboratories, Murray Hill, New Jersey, addresses the problem of near-end crosstalk associated with a patch plug of the aforedescribed type. The patch plug disclosed in the patent to Baker III et al includes a housing containing pairs of non-insulated flat blade contacts that cross-over and are spaced-apart from each other. The cross-over contacts add a controlled half-twist to each input wire pair for reduced crosstalk between conductor pairs within a patch plug and between adjacent patch plugs. However, the wire pairs are terminated at the flat blade contacts within the plug housing by conventional IDCs on the contacts. The further problems of IDC termination at the contacts and flat blade plugging at the cross-connect panel are not addressed by Baker III, et al.

It is the general aim of the present invention to provide an improved cord assembly which satisfies the requirements of Category 5 and which may be produced at a substantially lower cost than presently available cord assemblies. It is a further aim of the invention to provide an improved patch cord which wholly eliminates the requirements for contacts.

SUMMARY OF THE INVENTION

In accordance with the invention, an improved cord assembly for repeated plugging connection to and extraction from an inline array of insulation displacement connectors (IDCs) includes a cord assembly having a plurality of insulated solid wire conductors and a plug including a housing defining an exterior opening for receiving the insulation displacement connectors. The wire conductors have spaced apart bridging portions which extend across the exterior opening. A retaining means is provided for securing the bridging portions in predetermined positions relative to the housing and each other to cooperate in releasable plugging engagement within the insulation displacement connectors in response to insertion of the inline array of insulation displacement connectors into the exterior opening.

DETAILED DESCRIPTION OF PREFERRED EMBODIMENT AND METHOD

Figure 1:
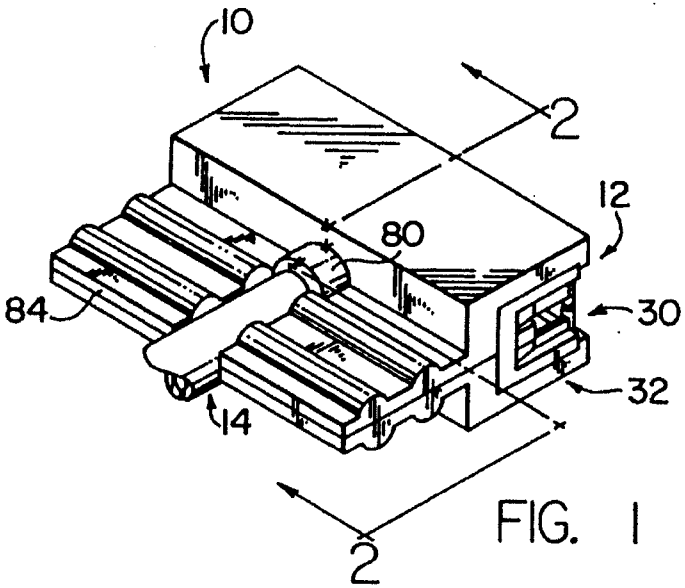
FIG. 1 is a fragmentary perspective view of a cord assembly embodying the present invention.
Figure 2:
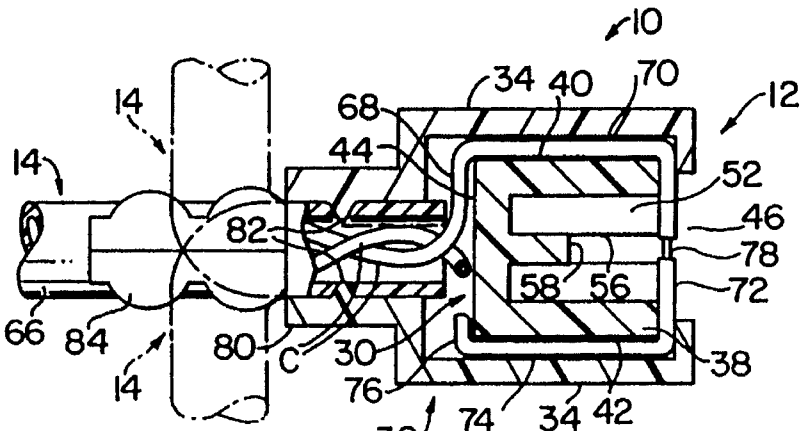
FIG. 2 is a somewhat enlarged fragmentary sectional view through the cord assembly taken generally along the line 2—2 of FIG. 1.

Referring now to the drawings, a cord assembly embodying the present invention is shown in FIGS. 1 and 2 and indicated generally by the reference numeral 10. The illustrated cord assembly 10 is particularly adapted for use as a patch cord for a cross-connect panel of the type usually found in large office buildings and other commercial establishments for networking the communications and data processing systems within a building and interconnecting these systems with an outside telecommunications network. The patch cord assembly 10 is generally used to selectively simultaneously interconnect a plurality of individual wire conductors terminated at such a cross-connect panel and includes a patch plug indicated generally at 12 and a patch cord attached to the plug and designated generally by the numeral 14.

Figure 4:
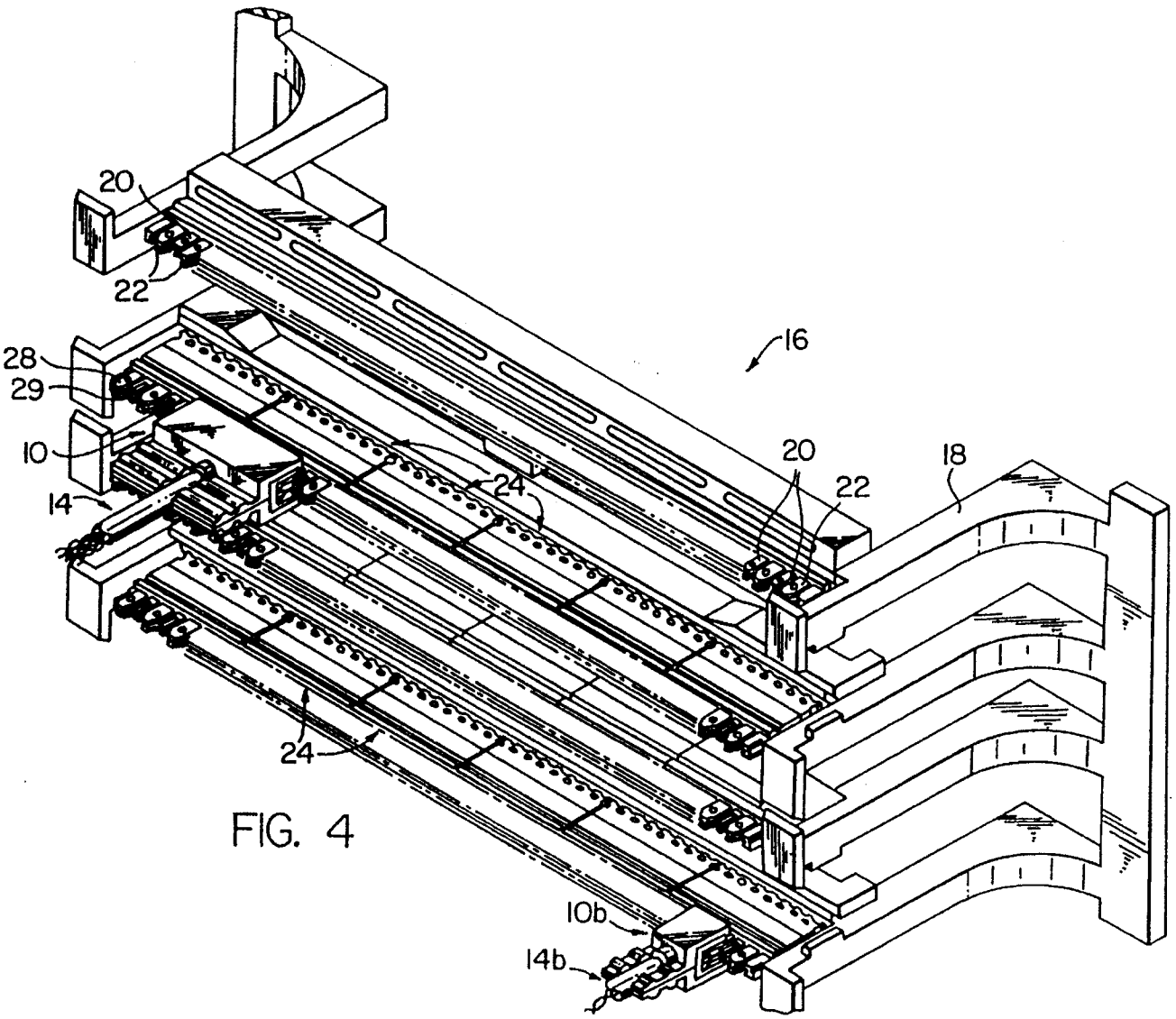
FIG. 4 is a perspective view of a typical cross-connect panel having two rows of attached connector blocks and shown with two cord assemblies attached thereto.

In FIG. 4 a typical wall mounted cross-connect panel of a type with which the patch cord assembly 10 is used is shown and indicated generally by the reference numeral 16. The illustrated panel 16 is an AT&T 110 cross-connect panel (110 AWI-100) and includes a frame 18 molded from dielectric plastic material. A plurality of rows of spaced apart first plugging elements 20, 20 and 22, 22 project from the frame. The end portions of individual wire conductors to be interconnected by patch cord assemblies at the cross-connect panel 16 are received in the spaces between the first plugging elements 20, 20 and 22, 22 and terminated by connector blocks indicated generally at 24, 24 which carry double ended IDC connectors and snap into lock-on engagement with the frame 18.

Figure 5:
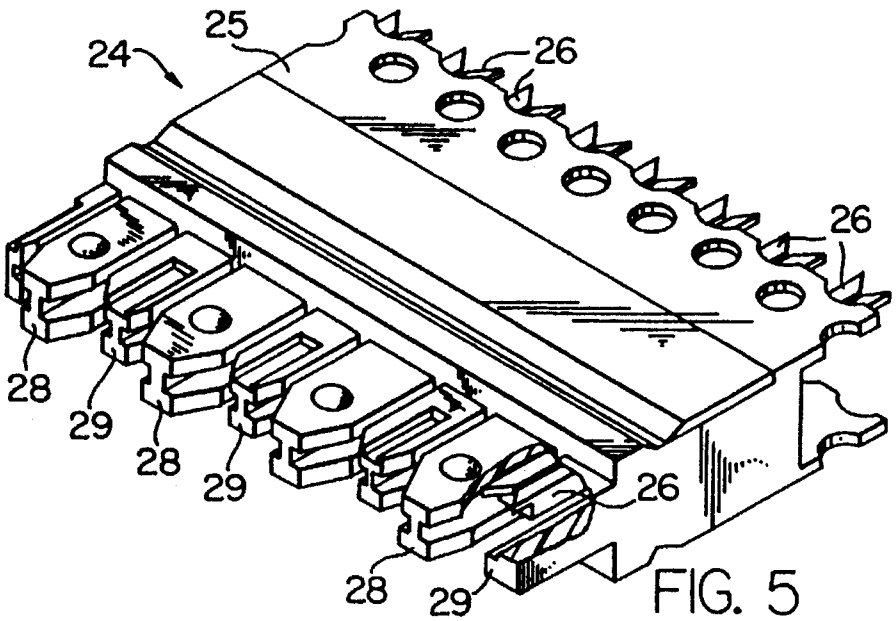
FIG. 5 is a somewhat enlarged perspective view of a typical connector block.

A typical connector block 24, shown in FIG. 5, has a dielectric body 25 and contains an in-line array of double ended connector elements 26, 26. Each connector element 26 has insulation displacement connectors (IDCs) at its opposite ends. The IDCs at the front ends of the connector elements 26, 26 project from the front or frame side of the connector block 24 and simultaneously terminate an inline array of individual wire conductors positioned in spaces between associated first plugging elements 20, 20 and 22, 22 on the frame 18 when the connector block 24 is pushed into snap-on locking engagement with the frame. The IDCs at the opposite or rear ends of the connector elements 26, 26 are exposed in spaces between second plugging elements 28, 28 and 29, 29 integrally formed on the rear end of the connector block body 25 and facilitate plugging connection with a patch plug 12 on an associated patch cord assembly 10.

A prior art patch cord assembly (not shown) for use with a cross-connect panel 16 usually includes a patch plug containing a plurality of plugging contacts which terminate the wire conductors of an associated patch cord attached to the patch plug and define flat contact blades for plugging insertion into the IDCs 26, 26 exposed between the second plugging elements 28, 28 and 29, 29 at the rear or plugging end of the cross-connect panel 16. The illustrated patch cord assembly 10 is particularly adapted for use as a retrofit patch cord assembly to replace a prior art patch cord assembly of the aforedescribed general type and wholly eliminates the need for separate plugging contacts generally employed in such prior art patch cord assemblies, as will be hereinafter evident.

Figure 3:
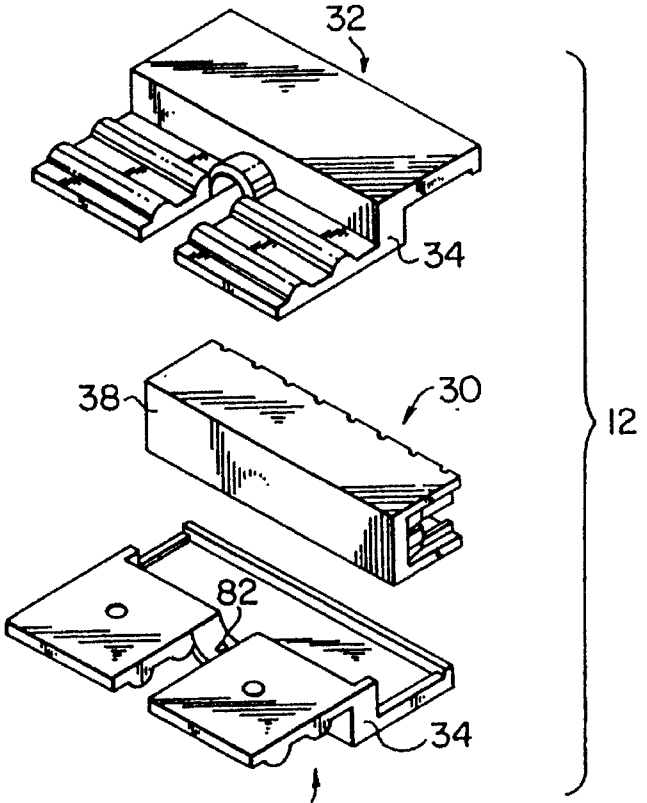
FIG. 3 is an exploded prospective view of the plug shown in FIG. 1.

Considering now the patch cord assembly 10 in further detail, the patch plug 12 may take various forms, but preferably, and as shown, it is molded from dielectric plastic material and has an inner part or body indicated generally at 30 and an outer part or shell designated generally by the numeral 32. The inner part is particularly adapted for plugging engagement with a plurality of second plugging elements 28, 28 and 29, 29 on an associated cross-connect panel to establish electrical connection with IDCs. The outer part 32 forms a housing for the inner part, is preferably formed by two substantially identical half sections 34, 34, as best shown in FIG. 3, and secures the patch cord 14 to the plug 12.

Figure 6:
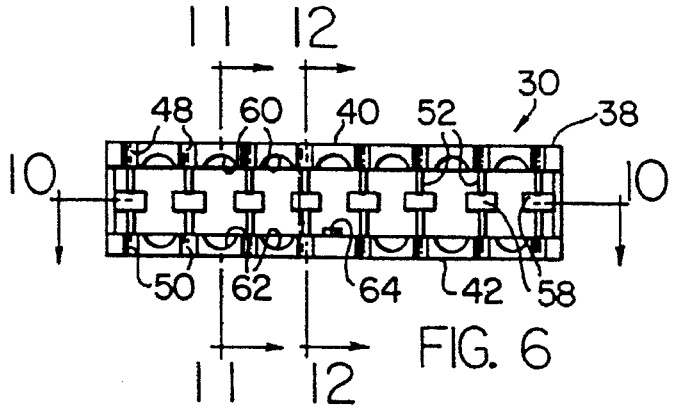
FIG. 6 is a front view of the plug inner part.
Figure 8:
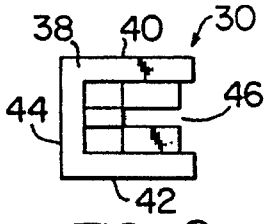
FIG. 8 is an end elevational view of the plug inner part.
Figure 7:
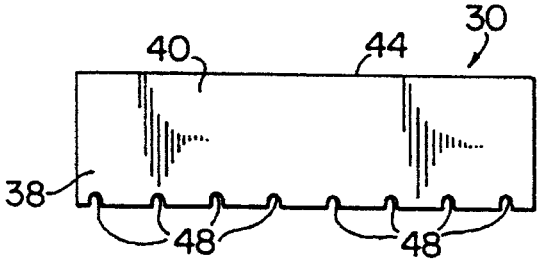
FIG. 7 is a top plan view of the plug inner part.
Figure 10:
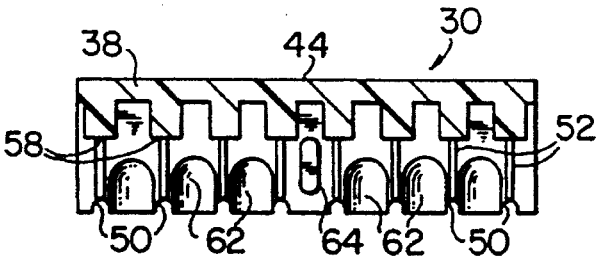
FIG. 10 is a sectional view taken generally along the line 10—10 of FIG. 6.
Figure 9:
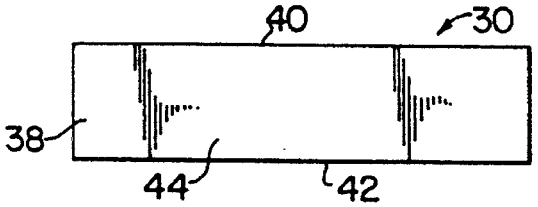
FIG. 9 is a rear elevational view of the plug inner part.
Figure 11:
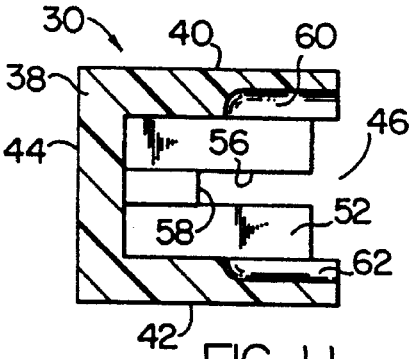
FIG. 11 is a somewhat enlarged sectional view taken along the line 11—11 of FIG. 6.
Figure 12:
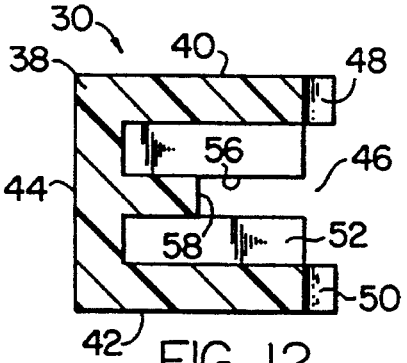
FIG. 12 is a somewhat enlarged sectional view taken along the line 12—12 of FIG. 6.

The inner part 30, as oriented in FIGS. 6–12, comprises a hollow generally rectangular body member 38 which has a top wall 40, a bottom wall 42, a rear wall 44 and an opening 46 at the forward end. A horizontally spaced apart series of vertically disposed and forwardly open notches 48, 48 are formed in the top wall 40 above the opening 46 as best shown in FIG. 7 and 12. The illustrated plug 12 is adapted to connect eight solid wire conductors to eight associated IDCs, therefore eight notches 48, 48 are provided. Another series of similar notches 50, 50 equal in number to the notches 48, 48 are formed in the bottom wall 42 below the frontal opening 46. Each notch 48 is vertically aligned with an associated notch 50 therebelow, as best shown in FIGS. 6 and 12. A plurality of vertically disposed and forwardly extending support walls 52, 52 cooperate with the top, bottom and rear walls 40, 42 and 44, respectively, and divide the hollow interior of the inner part 30 into a plurality of individual plugging element receptacles. Each support wall 52 has a forward end which terminates at an associated pair of upper and lower notches 48 and 50, as best shown in FIGS. 10 and 12, and defines a central horizontally disposed and forwardly open slot 56. The inner end of each slot 56 terminates at a forwardly facing abutment surface 58 defined by a rear portion of the dividing wall 52.

A series of forwardly and downwardly open recesses 60, 60 are formed in the top wall 40. Each recess 60 opens into an associated plugging element receptacle between a pair of adjacent dividing walls 52, 52 to provide clearance for first plugging elements 20, 20 and 22, 22. Similar but opposing recesses 62, 62 are formed in the bottom wall 42 for the same purpose and open into all but the central plugging element receptacle, as best shown in FIGS. 6 and 10. A boss 64 integrally formed on the bottom wall 42 projects into the central plugging element receptacle as shown in FIGS. 6 and 10, for a purpose which will be hereinafter further explained.

The patch cord 14 comprises a flexible insulated cable which has an outside insulation jacket 66 containing four pair of twisted insulated solid wire conductors C, C. The conductors of each pair are twisted about each other a plurality of times along the length of the cable. Terminal end portions of each pair of conductors C, C extend from and beyond the insulation jacket 66 and are untwisted or separated from each other along sufficient lengths to enable an end portion of each conductor C to be wrapped about an associated outer peripheral surface portion of the inner part 30, as shown in FIG. 2. The terminal end portion of a typical conductor C, shown in FIG. 2, has a first segment 68 which extends for some distance along the outer surface of the back wall 44, a second segment 70 which extends across the outer surface of the top wall 40, a third or bridging segment 72 which extends downwardly across the opening 46 and through an associated pair of upper and lower grooves 48 and 50, a fourth segment 74 which extends along the bottom wall 42, and a fifth segment 76 which extends upwardly along an associated portion of the rear wall 44 terminating on the rear wall, substantially as shown. It will be noted that a portion of the insulation on each third or contact defining segment 72 is displaced exposing a contact portion of each conductor C within the opening 46 and in alignment with an associated slot 56. The exposed or bare contact portion of the solid wire conductor C shown in FIG. 2 is indicated by the numeral 78.

The two half sections 34, 34 which comprise the outer part 32 cooperate in assembly to provide a clamshell-like housing for the inner part 30. Sufficient clearance is provided between the inner surfaces of the outer part 32 and the associated outer peripheral surfaces of inner part 30 to accommodate the terminal end portions of the various conductors C, C wrapped about the inner part. The outer part 32 and the inner part 30 cooperate in assembly to trap the terminal end portions of the various conductors C, C therebetween and retain the various associated segments which comprise these conductor end portions in predetermined positions within and relative to the patch plug 12.

The half sections 34, 34 are preferably bonded or welded together in assembly and define an annular collar 80 which surrounds an associated end portion of the outer insulation jacket 66. Projections 82, 82 on the inner surface of the annular collar 80, best shown in FIG. 2, incise and grip the cord or cable jacket 66 to provide strain relief for the patch cord 14. The half sections 34, 34 further cooperate in assembly to form a rearwardly projecting handle 84 on the plug 12.

When the patch plug 12 is plugged into engagement with an inline array of second plugging elements 28, 28 and 29, 29 on an associated cross-connect panel, such as the panel 16, as shown in FIG. 4 the abutment surfaces 58, 58 on the patch plug cooperate with the forward ends of the projecting second plugging elements 28, 28 and 29, 29 to limit insertion of the latter elements into the patch plug 12. The exposed or bare contact portions 78, 78 of the conductors C, C establish direct contact with IDCs 26, 26 located between associated second plugging elements 28, 28 and 29, 29 on the panel 16 thereby wholly eliminating the need for blade-like plugging contacts such as those employed in patch cord assemblies of the prior art.

Figure 13:
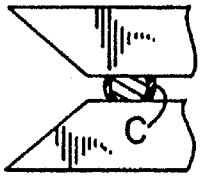
FIG. 13 is a somewhat schematic enlarged fragmentary sectional view through an insulated wire conductor disposed in plugging engagement within an associated IDC.

Initial plugging engagement of the bridging portion 72 of each insulated conductor C into an associated IDC 26 causes some flattening of the contact surfaces on the wire conductor C as shown in FIG. 13. However, this flattening is advantageous because it increases the area of contact between each conductor C and its associated IDC 26. This flattening or deformation of the conductor in the region of contact does not appreciably increase with repeated plugging and unplugging of the patch cord assembly so that a high degree of contact integrity is maintained throughout the life of the patch cord assembly.

The patch plug 10 cannot be plugged onto the cross-connect panel 16 when one of the second plugging elements 28 is aligned with a central plug receptacle containing a boss 63. The boss 64 cooperates with each second plugging element 28 to provide interference and prevent improper plugging thereby assuring proper plugging polarity.

A patch cord made in accordance with the invention may be provided to accommodate any number of twisted wire pairs. In FIG. 4 there is shown another patch cord assembly indicated at **10*b* and including a cord 14*a*** containing a single twisted wire pair.

Figure 14:
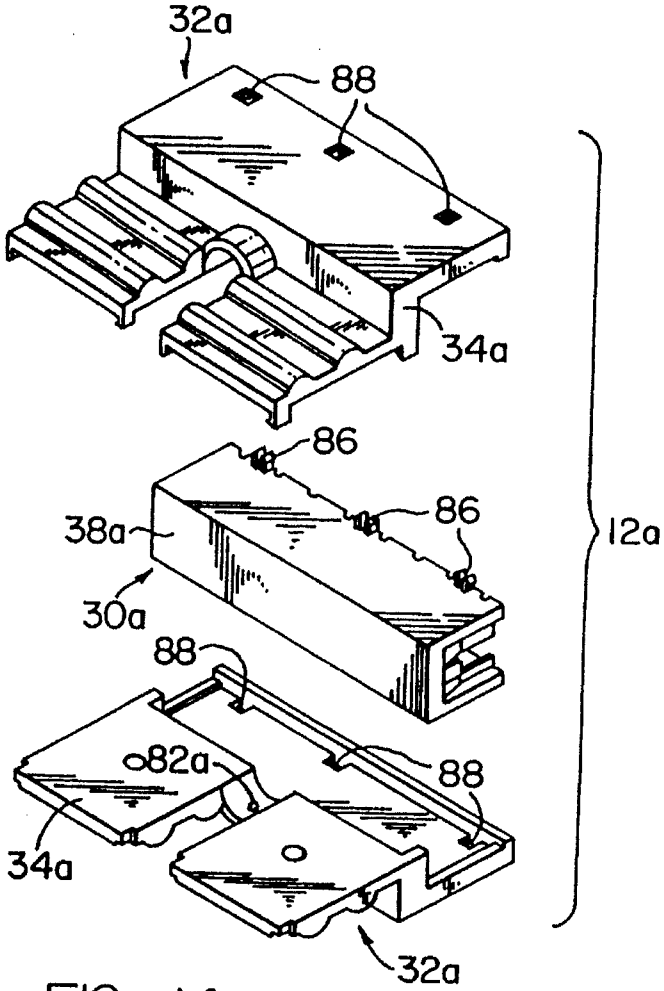
FIG. 14 is an exploded perspective view illustrating another patch plug embodying the invention.

In FIG. 14 there is shown an exploded perspective view of another patch plug **12*a* used in practicing the invention. The patch plug 12*a* is similar in most respects to the patch plug 12 previously described and parts of the plug 12*a* which correspond to previously described parts bear the same reference numeral and a letter a suffix. Specifically, the plug 12*a* differs from the plug 12 in the manner in which the outer parts 34*a*, 34*a* are assembled with the inner part 30*a* to partially encapsulate the inner part. The outer parts 34*a*, 34*a* are adapted for snap-together assembly with the inner part. Resilient locking elements 86, 86 carried by the inner part are received within associated apertures 88, 88 formed in the outer parts 34*a*, 34*a*** when the plug parts are brought together in assembled relation to each other. A patch cord assembly which utilizes a patch plug of this type is particularly adapted for field assembly, thereby enabling a cord assembly to be produced in any desired length as may be required to satisfy a particular need encountered in the field.

Figure 15:
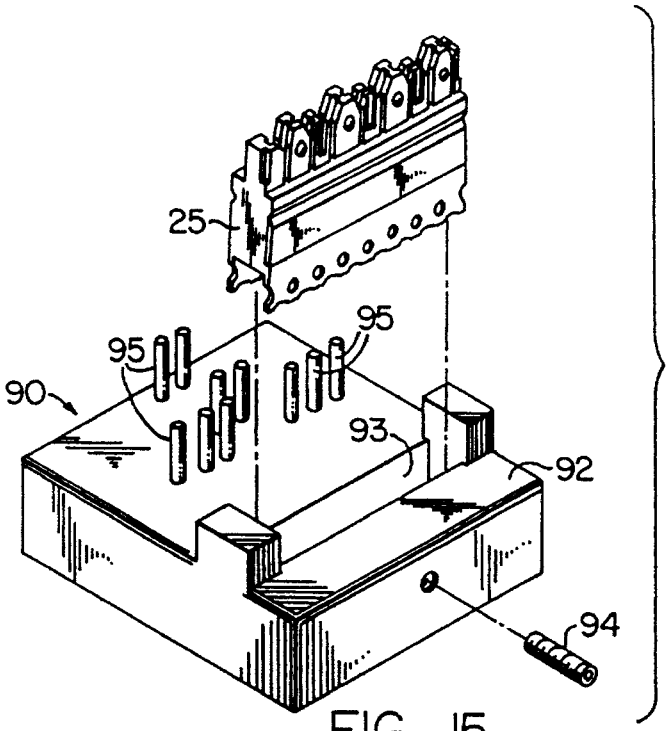
FIG. 15 is an exploded perspective view of a jig used in making a cord assembly in accordance with the present invention.

Preparatory to making a patch plug assembly 10 a portion of the outer insulation jacket 66 is removed from a patch cord 14 to expose end portions of the twisted pairs of insulated wire conductors C, C contained within the cord. The terminal end portions of each twisted pair are untwisted and arranged in predetermined spaced part and generally parallel relation to each other. An assembly jig indicated generally at 90 for properly positioning the terminal end portions of the various individual conductors C, C is illustrated in FIG. 15. The jig 90 has a base 92 including a cavity 93 receiving a connector block body 25 which is secured to the base by a set screw 94. The jig 90 further includes a plurality of alignment pins 95, 95 which project from the base 92 and cooperate with the connector block body 25 to provide a means for aligning the individual terminal end portions in proper position relative to each other for wrap around assembly with an associated inner part 30.

Figure 16:
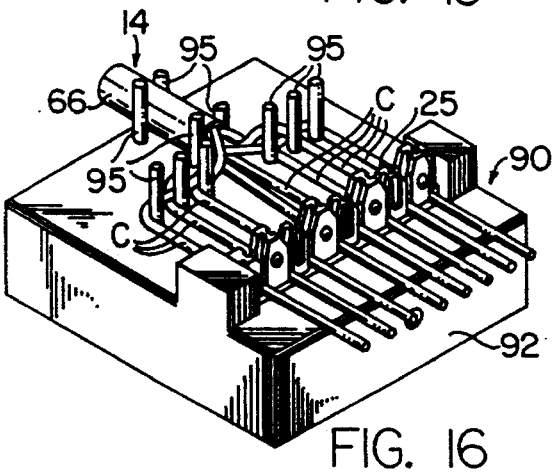
FIG. 16 is a perspective view illustrating a step in a method for making the cord assembly shown in FIG. 1.
Figure 17:
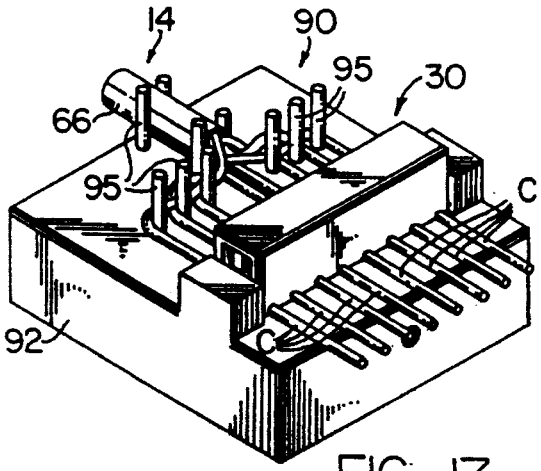
FIG. 17 is similar to FIG. 16 and illustrates a further step in the method.
Figure 18:
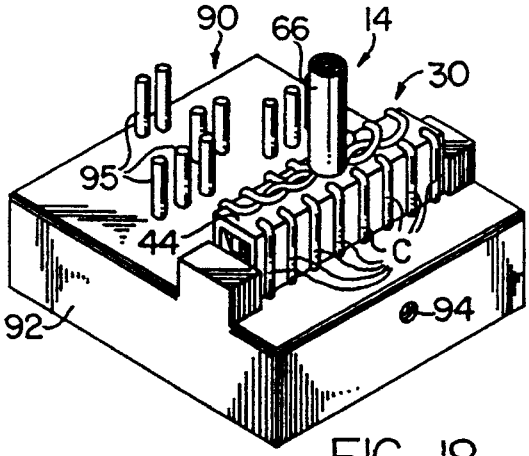
FIG. 18 is similar to FIG. 16 and illustrates still another step in the method.

After the terminal end portions of the conductors C, C have been positioned on the jig, as shown in FIG. 16, an inner part 30 is plugged onto the upwardly projecting plugging elements 28, 28 and 29, 29 on the jig 90 as shown in FIG. 17. Thus, the individual insulated wire conductors C, C are properly positioned relative to each other and to the inner part to extend across the opening 46 in the inner part 30. Each insulated conductor C is disposed within a pair of aligned notches 48 and 50 in the upper and lower walls of the inner part 30. While the inner part 30 remains in position on the jig 90 the terminal end portions of the wire conductors C, C are wrapped about the outer peripheral surfaces of the inner part, substantially as shown in FIG. 18. It will be noted that the twisted pairs which extend to the outboard ends of the inner part 30 extend in twisted condition for some distance along the outer surface of the rear wall 44 to positions of alignment with the outermost or outboard notches 48 and 50 in the inner part.

Thus, each individual wire conductor is wrapped about the inner part to extend along exterior surfaces of the rear wall, the bottom o wall and the top wall, substantially as shown. Upon completion of the conductor wrapping operation the sub-assembly comprising the patch cord 14 and the inner part 30 appear as shown in FIG. 18. The completed sub-assembly which comprises the inner part with the patch cord 14 wrapped therearound is then removed from the jig 90. The plug assembly is completed by assembling the outer parts 34, 34 on the sub-assembly as previously described.

I claim:

1. A cord assembly for releasable plugging connection to an inline array of insulation displacement connectors including at least two connectors, said cord assembly comprising a plug having a housing defining an exterior opening for receiving the insulation displacement connectors, a cord including a plurality of insulated solid wire conductors having spaced apart bridging portions extending across said exterior opening, reinforcing means on said housing for supporting said bridging portions, and retaining means for securing said bridging portions in predetermined positions relative to said housing and each other to cooperate in releasable plugging engagement within the insulation displacement connectors in response to insertion of the inline array of insulation displacement connectors into said opening.

2. A cord assembly as set forth in claim 1 wherein said housing has an inner part and an outer part and said outer part comprises said retaining means.

3. A cord assembly as set forth in claim 2 wherein said insulated solid wire conductors extend around associated outer surface portions of said inner part between said inner part and said outer part.

4. A cord assembly as set forth in claim 2 wherein said retaining means includes a plurality of notches in said housing receiving associated portions of said insulated solid wire conductors therein.

5. A cord assembly as set forth in claim 4 wherein said notches are disposed at opposite sides of said exterior opening.

6. At cord assembly as set forth in claim 2 wherein said outer part comprises a plurality of sections and said plug includes securing means for maintaining said sections in assembly with each other.

7. A cord assembly as set forth in claim 6 wherein said securing means comprises a bonding agent.

8. A cord assembly as set forth in claim 6 wherein said securing means comprises means for retaining said sections in snap-together assembly with each other.

9. A cord assembly as set forth in claim 1 wherein said reinforcing means comprises a plurality of webs disposed within said exterior opening generally adjacent said bridging portions.

10. A cord assembly as set forth in claim 1 wherein said plug includes a handle projecting from said housing.

11. A cord assembly as set forth in claim 10 wherein said housing has an inner part and an outer part and said handle comprises a portion of said outer part.

12. A cord assembly as set forth in claim 1 wherein said insulated solid wire conductors comprises at least one pair of insulated solid wire conductors twisted about each other a plurality of times along the length of said cord.

13. A cord assembly as set forth in claim 1 wherein the insulation on each of said bridging portions is displaced and an associated contact portion of each of said solid conductors is exposed within said exterior opening by said displaced insulation.

14. A method for making a plug and cord assembly for releasable plugging connection with an inline array of insulation displacement connectors comprising the steps of forming a plug body having an exterior opening for receiving the insulation displacement connectors, forming a plurality of reinforcing webs on said housing in predetermined spaced apart positions within said opening and in bridging relation to said opening providing an electrical cord having a plurality of insulated solid wire conductors, arranging terminal end portions of the conductors in predetermined spaced apart positions relative to each other, positioning the spaced apart terminal end portions adjacent the plug body with contact defining segments of the terminal end portions in bridging relation to the exterior opening and with each of the contact defining segments disposed in parallel alignment with and supported by an associated one of the reinforcing webs, wrapping the remaining segments of the terminal end portions about the plug body, and securing the remaining segments to the plug body.

15. A method for making a plug and cord assembly as set forth in claim 14 including the additional step of forming a plug housing for containing the plug body and the remaining segments of the terminal end portions and wherein the step of securing the remaining segments comprises assembling the plug housing with the plug body trapping the remaining segments between the plug body and the plug housing.

16. A method for making a plug and cord assembly as set forth in claim 15 wherein the plug housing is formed by a plurality of separate parts the step of assembling the plug housing further comprises joining the plug housing parts in snapped together assembly.

17. A method for making a plug and cord assembly as set forth in claim 15 wherein the plug housing is formed by a plurality of parts and the step of assembling further comprises ultrasonically welding the plug housing parts in assembly.

18. A method for making a plug and cord assembly as set forth in claim 15 wherein the plug housing is formed by a plurality of parts and the step of assembling further comprises adhesively bonding the plug housing parts in assembly.

19. A method for making a plug and cord assembly as set forth in claim 14 including the additional step of forming notches in the plug body at opposite sides of the exterior opening and wherein the step of positioning the terminal end portions comprises positioning the contact defining segments the notches before the step of assembling is performed.

* * * * *